United States Patent [19]

Nayagam

[11] 4,060,218

[45] Nov. 29, 1977

[54] PNEUMATICALLY CONTROLLED RIGID CORE-FORMER

[76] Inventor: Kandiah Tharma Nayagam, No. 6B 2nd Floor, Lorong Medan Tuanku Satu, Kuala Lumpur, Malaysia

[21] Appl. No.: 696,125

[22] Filed: June 14, 1976

[30] Foreign Application Priority Data

June 26, 1975 United Kingdom ..... 27090/75

[51] Int. Cl.[2] ..... B28B 7/32

[52] U.S. Cl. ..... 249/65; 249/153; 249/179; 249/183

[58] Field of Search ..... 249/65, 153, 179, 180, 249/183, 184

[56] References Cited

U.S. PATENT DOCUMENTS

| | | | |
|---|---|---|---|
| 1,162,961 | 12/1915 | Williams | 249/180 |
| 1,242,092 | 10/1917 | Wazbinski | 249/180 |
| 2,170,188 | 8/1939 | Cobi | 249/65 |
| 2,315,634 | 4/1943 | McCall | 249/179 |
| 3,074,140 | 1/1963 | Balcomb et al. | 249/65 |

FOREIGN PATENT DOCUMENTS

| | | | |
|---|---|---|---|
| 676,356 | 7/1952 | United Kingdom | 249/183 |
| 674,986 | 7/1952 | United Kingdom | 249/65 |

*Primary Examiner*—Francis S. Husar
*Assistant Examiner*—John McQuade
*Attorney, Agent, or Firm*—Lowe, Kokjer, Kircher, Wharton & Bowman

[57] ABSTRACT

A form assembly which may be used to provide a core portion in a concrete or other cast structure. A pair of former elements having interfitting hooks and flanges which are normally urged apart by a resilient sleeve which fits over the former elements. The sleeve biases the former elements to a collapsed position in which they may be inserted and removed. An inflatable tube is interposed between the former elements and may be inflated to move the elements to an expanded position wherein forming surfaces of the elements cooperate to provide a core about which concrete or the like may be poured.

5 Claims, 8 Drawing Figures

PNEUMATICALLY CONTROLLED RIGID CORE-FORMER

BACKGROUND AND SUMMARY OF THE INVENTION

This invention relates to rigid core formers for use in the construction of concrete or other structures.

It is among the objects of the present invention to provide a rigid core former which is simple to erect and use, and one which can be used repeatedly without the need to completely dismantle it each time it is used.

According to the present invention, there is provided a rigid core former comprising a pair of interengaging former elements each element having at least one forming surface, a resilient sleeve surrounding the former elements and serving normally to bias them into a first position, and means for moving the former elements relative to one another, against the action of the resilient sleeve, into a second position.

Preferably, the resilient sleeve is of rubber and the means for moving the former elements relative to one another are pneumatic means in the form of an inflatable rubber or other tube.

DETAILED DESCRIPTION OF THE INVENTION

Figure 1:
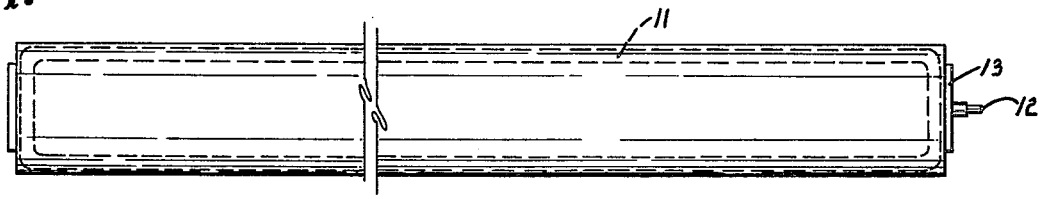
Figure 2:
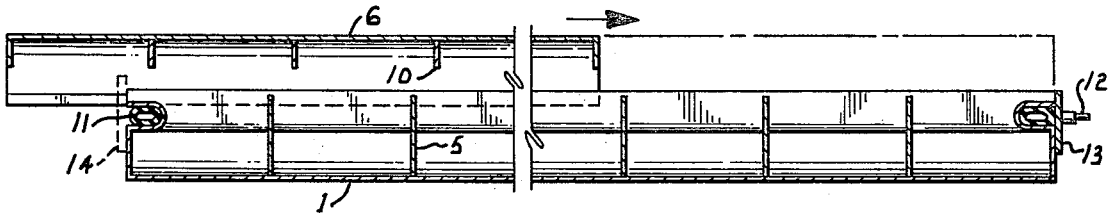
Figure 3:
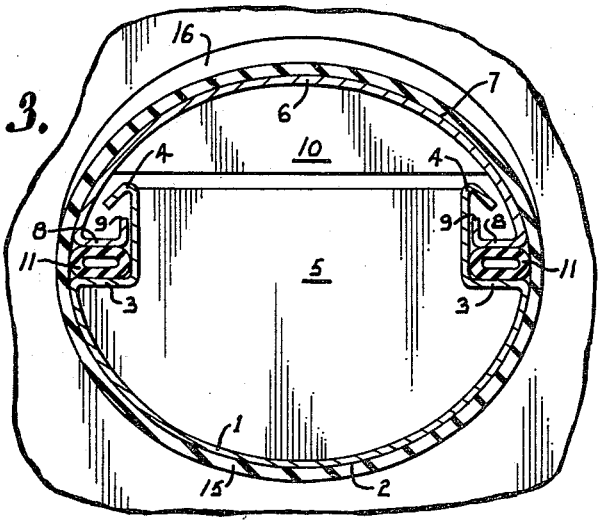
Figure 4:
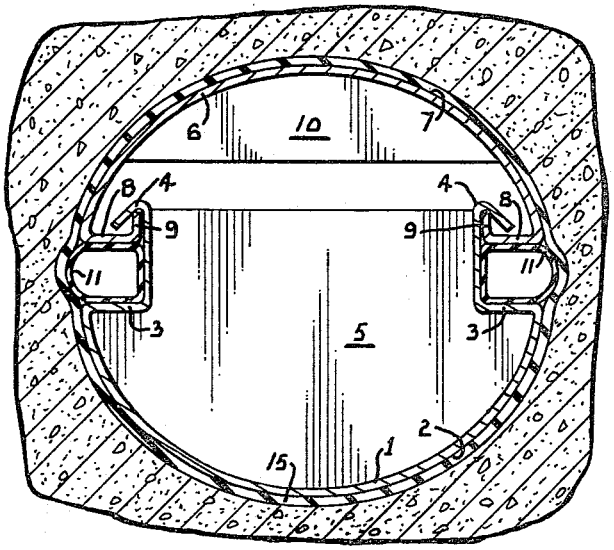
Figure 5:
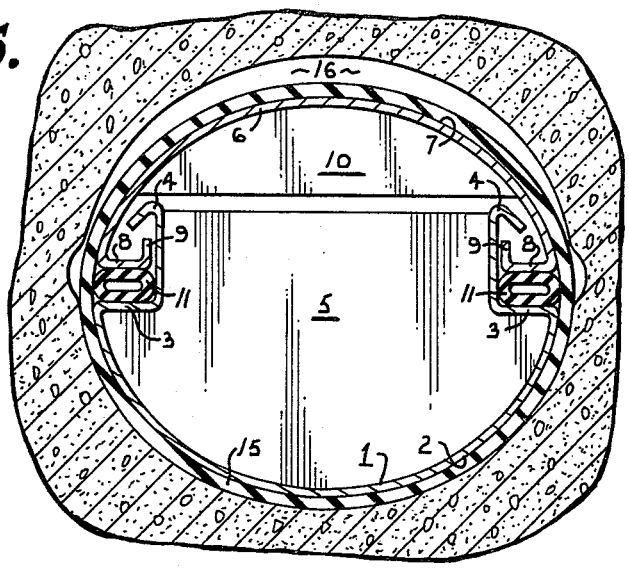
Figure 6:
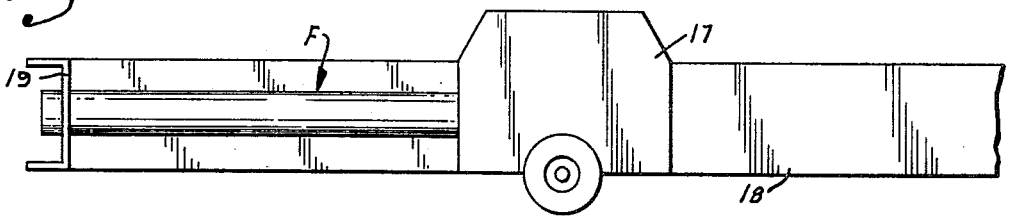
Figure 7:
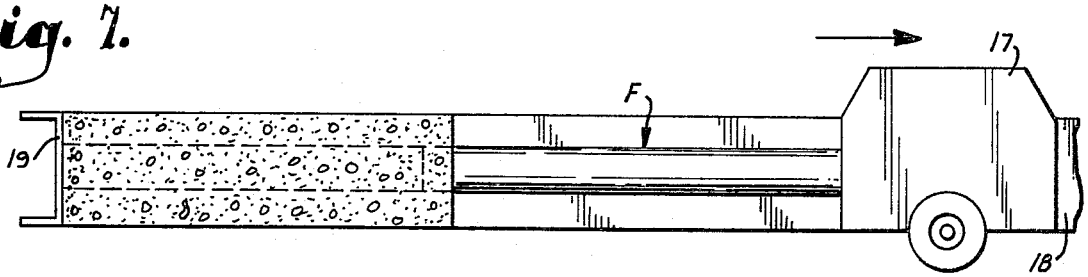
Figure 8:
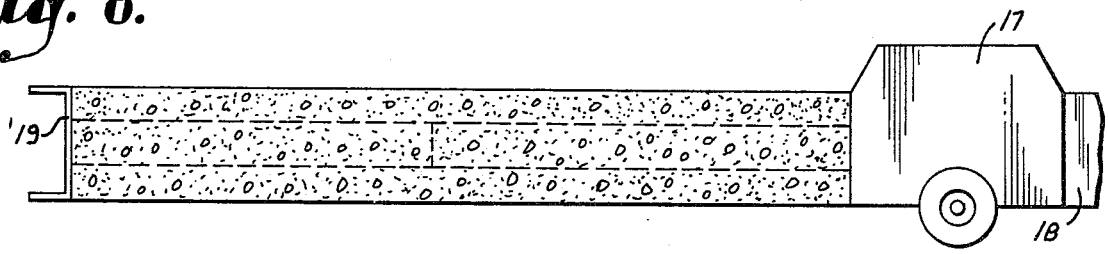

The invention is illustrated by way of example in the accompanying drawing in which, FIG. 1 is a plan view of a core former according to the invention, FIG. 2 is a corresponding vertical section showing the manner of assembling the former, FIG. 3 is a cross-section, on an enlarged scale, showing the former in its first or non-expanded position in an opening in the shuttering, FIG. 4 is a cross-section corresponding to FIG. 3 showing the former in its second or expanded position, FIG. 5 is a cross-section corresponding to FIG. 3 and showing the former in its first or non-expanded position prior to withdrawal after forming a concrete structure, and FIGS. 6, 7 and 8 are schematic side elevations on a small scale showing the use of the former in a continuous casting process.

Referring to the drawing, the invention is illustrated with reference to core former which is provided to form an opening of oval cross-section in a concrete structure.

The former comprises a lower former element 1 having an arcuate forming surface 2, the ends of the element each having an inwardly directed radially extending portion 3 and a hook-like portion 4 extending perpendicular to, and in continuation of, the portion 3. Spaced stiffeners or reinforcing plates 5 are positioned along the length of the element 1.

The former also includes an upper former element 6 having an arcuate forming surface 7, the ends of the element each having an inwardly directed radially extending portion 8 and a flange portion 9 extending perpendicular to, and in continuation of, the portion 8. Spaced stiffeners or reinforcing plates 10 are positioned along the length of the element 6.

As shown in FIG. 2 of the drawing, the former elements 1 and 6 are assembled by sliding the element 6 lengthwise relative to the element 1 so that the flange portions 9 enter into a position where they interlock with their co-acting hook-like portions 4 as shown in FIGS. 3 to 5 of the drawing. In this respect, it will be seen that the relative lengths of the portions 4 and 9 are such that limited relative movement between them is allowed to take place.

Furthermore, an endless inflatable tube 11 is positioned between the radially extending portions 3 and 8, the inflation valve 12 of the tube being fixed in an end plate 13 which is secured to the lower element 1 and serves to position the elements 1 and 6 relative to one another. A second end plate 14 is positioned at the other ends of the two elements 1 and 6 to retain them in position.

The tube 11 is preferably of flat cross-section and, when in its inflated condition, the depth thereof is between one half and three quarters of the width thereof.

The structure so formed is enclosed in an open-ended resilient sleeve 15. This sleeve is made to have a close fit and is such that it can be pulled over the two elements 1 and 6 without difficulty but, at the same time, is not loose when in place. The sleeve 15 serves to bias the elements 1 and 6 into the first or non-expanded position as shown in FIGS. 3 and 5 of the drawing.

In use, the core former is, as shown in FIG. 3, positioned in a casting mould spaced openings 16 corresponding cross-sections to that of the expanded former. In order to move the elements of the former into the second or expanded position, air is introduced into the tube 11 via the valve 12 and this forces apart the former elements 1 and 6 against the action of the sleeve 15. This movement is continued until the flanges 9 engage the hook-like portions 4 in which position the profile of the former corresponds to that of the opening required, as can be seen in FIG. 4. At the same time as the two elements 1 and 6 separate, the side of the tube 11 adjacent the sleeve 15 expands and forces the sleeve away from the joint between the two former elements 1 and 6. The distance to which the sleeve is forced away from the said joint is controlled by the pressure in the tube 11 and, in order to ensure that the pressure which forces the two elements 1 and 6 apart is greater than that applied to the sleeve 15, the tube 11 is shaped and proportioned in the manner hereinbefore described.

Concrete is then poured into the mould and allowed to set. Thereafter, the tube 11 is deflated so that the former elements 1 and 6 return to their first or non-expanded positions as shown in FIG. 5. The former can then be removed and re-used.

Thus, it will be seen that the core former according to the invention has the advantage that it has no mechanical parts which can go wrong, and that it can be made in very small sections, or in very narrow but wide sections, in an economical way, for example, by extrusion, rolling or bending, to the desired profile. Furthermore, the former is completely rigid and is therefore self-supporting and does not require external support.

A further advantage is that, since relative movement between the former elements can be effected without shock, very early removal of the former from the mould is possible thereby saving valuable time.

In addition, the core former need not be dismantled and reassembled each time it is used since its expansion and contraction is effected by pneumatic means and therefore there are no removable parts. For this reason, the core former can be used to advantage to form long continuous castings in an automatic process.

FIGS. 6 to 8 of the drawing show schematically the manner of using the core former in an automatic process. Thus, as shown in FIG. 6, a plurality of spaced formers F are attached, at one end, to a travelling inflation machine 17 arranged to move lengthwise of a casting bed 18. The other ends of the formers F are supported in shuttering 19. In this position, the formers are expanded and concrete is poured into the casting bed. When the concrete is set, as is shown in FIG. 7, the formers are collapsed and the machine 17 is moved to a position where a further section of the casting bed is exposed and the free ends of the formers are supported in the core formed in the cast section. This process is repeated in a step by step motion to provide castings of any desired length.

It will further be appreciated that the former structure is totally enclosed at all times and therefore is completely protected against the ingress of dirt or concrete which could hinder its operation.

I claim:

1. A form assembly for use in forming a core portion of a structure, comprising:

a pair of former elements each having an exterior forming surface, said former elements being adapted to fit together and being relatively movable between a first collapsed position and a second expanded position wherein said former elements interfit with one another with their forming surfaces cooperating to present a surface for shaping the core;

a resilient sleeve member closely fitting on said former elements in substantially surrounding relation thereto;

a hook member on one of said former elements;

a hook engaging member on the other of said former elements adapted to engagingly interlock with said hook member in the expanded position and separated from said hook member in the collapsed position; and means located between said former elements for effecting relative movement thereof from said collapsed to said expanded position.

2. The invention set forth in claim 1, wherein the last named means comprises pneumatic means.

3. The invention set forth in claim 2, wherein said pneumatic means comprises an inflatable tube interposed between said former elements, said tube being inflatable to move said former elements from the collapsed to the expanded position.

4. A form assembly for use in forming a core portion of a structure, comprising:

a pair of former elements each having a smooth, continuous forming surface and terminal edge portions extending longitudinally of the element, said former elements being adapted to fit together and being relatively movable between a first collapsed position and a second expanded position wherein said former elements interfit with one another with their former surfaces cooperating to present a substantially continuously extending surface for shaping the core;

a resilient sleeve member closely fitting on said former elements in substantially surrounding relation thereto;

an inflatable tube member located between opposed edge portions of the respective former elements in substantially continuous extension longitudinally of the elements;

means operatively associated with said tube member for inflating said tube member to move said former elements from the collapsed position to the expanded position; and interlocking means on the edge portions of said former elements operable to engagingly interlock opposed edge portions with one another when in the expanded position.

5. The invention set forth in claim 4, wherein said interlocking means comprises hook members on the edge portions of one former element and hook engaging members on the edge portions of the other former element, said hook and hook engaging members engaging one another in the expanded position and separated from one another in the collapsed position.

* * * * *